United States Patent [19]

Magee

[11] 3,967,019

[45] June 29, 1976

[54] ORNAMENTAL ARTIFICIAL TREE

[76] Inventor: Audra Fay Magee, 430 Huron Ave., Bogalusa, La. 70427

[22] Filed: Nov. 29, 1974

[21] Appl. No.: 528,016

[52] U.S. Cl. ..... 428/7; D29/1 A; 240/10 T; 428/18; 428/19

[51] Int. Cl.[2] ..... A47G 33/06

[58] Field of Search ..... D29/1 A; 161/31, 24, 161/22, 23, 19, 27; 240/10 T; 428/7, 18, 19

[56] References Cited

UNITED STATES PATENTS

| | | | |
|---|---|---|---|
| 1,764,540 | 6/1930 | Vydra | 161/24 |
| 2,731,752 | 1/1956 | Erickson | D29/1 A |
| 2,913,843 | 11/1959 | Wittuk | D29/1 A |
| 3,210,232 | 10/1965 | Wielland | 161/24 |
| 3,677,867 | 7/1972 | Westlund | 161/24 |
| 3,692,617 | 9/1972 | Marks | 161/31 |
| 3,704,366 | 11/1972 | Korb | 240/10 T |
| 3,819,459 | 6/1974 | Wren | 161/24 |
| D200,455 | 2/1965 | Freund | D6/20 |

*Primary Examiner*—William J. Van Balen
*Assistant Examiner*—Ellis P. Robinson
*Attorney, Agent, or Firm*—Edgar E. Spielman, Jr.; David L. Ray

[57] ABSTRACT

A self-supporting, ornamental, artificial tree is disclosed which comprises: a base; a plurality of elongated members attached at one of their ends to the base by attachment means and attached at their other ends one to the other, these attached support members together forming a cone-shaped ornament support frame; and ornaments attached to the cone-shaped, ornament support frame.

8 Claims, 6 Drawing Figures

ORNAMENTAL ARTIFICIAL TREE

BACKGROUND OF THE INVENTION

Many different forms of artificial, ornamental trees have heretofore been proposed. Exemplary of such various forms are found in U.S. Pat. No. 1,764,540, U.S. Pat. No. 3,210,232, U.S. Pat. No. 3,746,601 and Des 200,455. All of these forms except for the form disclosed in the last mentioned patent, utilize a center trunk or pedestal to hold the ornamental tree upright. As can be appreciated, such a support is not especially sturdy and thus has a tendency to tip over. The tree disclosed in Des 200,455, while it does not utilize a central trunk for support, does disclose only half a tree which is only to be viewed from one side. It should also be pointed out that the various ornamental tree forms shown in the above-mentioned patents are rather complex in structure, requiring many pieces and thus do not readily lend themselves to economic construction—the more pieces in the tree, the more fabrication time required for the tree.

Therefore it is an object of this invention to provide an ornamental tree which is sturdy and is designed so that tipping over of the tree is essentially avoided. It is a further object of this invention to provide a tree which is of simple construction whereby the highest fabrication efficiency is possible.

THE INVENTION

This invention relates to a self-supporting, ornamental tree which has (1) a base, (2) a plurality of elongated members which members are attached at one of their ends to the base by an attachment member and attached at their outer ends one to the other, whereby the attached support members together form a cone-shaped support frame, and (3) ornaments attached to the cone-shaped support frame.

The base may be of any shape, with a circular shape being most preferred. When a circular shape is utilized the apex of the formed cone-shaped support frame will fall on the center axis of the circular base. The circular base may also have different thicknesses.

Preferably the connection of the elongated members one to the other is achieved by merely wrapping them together with wire. However, other modes of connection may be utilized such as by soldering and the like. A secure connection of the elongated members to the attachment member is preferably achieved by forming a loop at that end of the elongated member and passing the attachment member through the loop. Making this connection more rigid can be achieved by soldering at the point of connection.

These and other features of the invention contributing satisfaction in use and economy in manufacture may be more fully understood from the following description of a preferred embodiment of the invention when taken in connection with the accompanying drawings, in which identical numerals refer to identical parts and in which.

Figure 1:
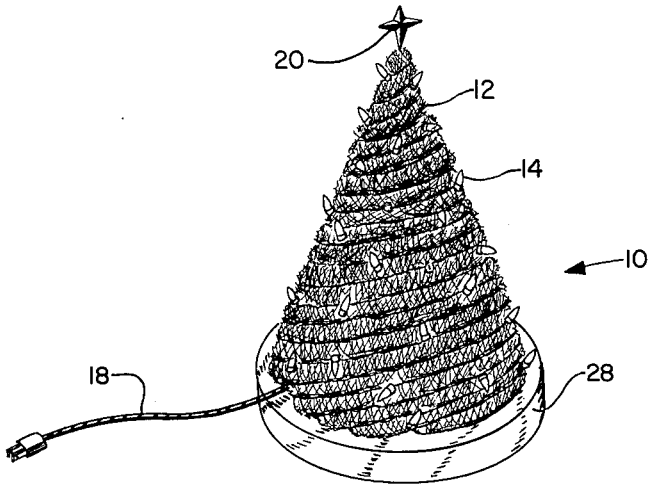
FIG. 1 is a perspective view of an embodiment of this invention.

Referring now to FIG. 1, it can be seen that an ornamental, artificial tree of this invention, generally designated by the numeral 10, has a base 28 and a cone-shaped top resting thereon to resemble an artificial, ornamental tree. The cone-shaped tree is ornamented with electric lights 14 and garland 12 and a star 20 at the apex of the cone. Electric light cord 18 is utilized to communicate electricity to electric lights 14. As can be seen from the drawing, the garland and lights are laid in a spiraled pattern. This spiraled pattern is preferred, however other patterns may be utilized as the need may arise.

Figure 2:
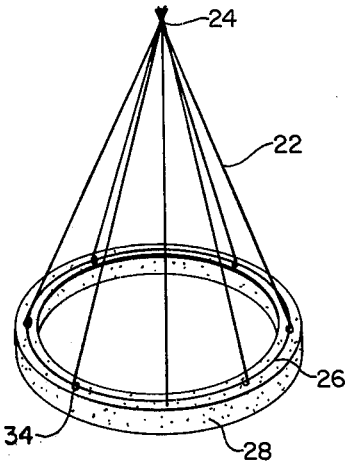
FIG. 2 is the embodiment shown in FIG. 1 without the ornaments attached.
Figure 3:
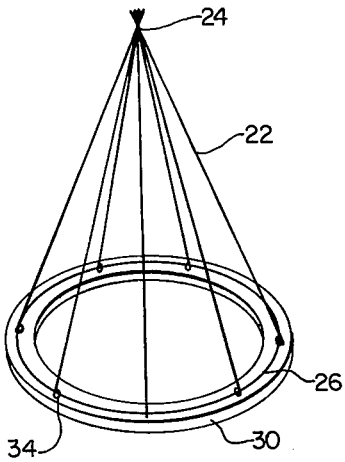
FIG. 3 is a perspective view of a second embodiment of this invention without the ornaments attached.
Figure 4:
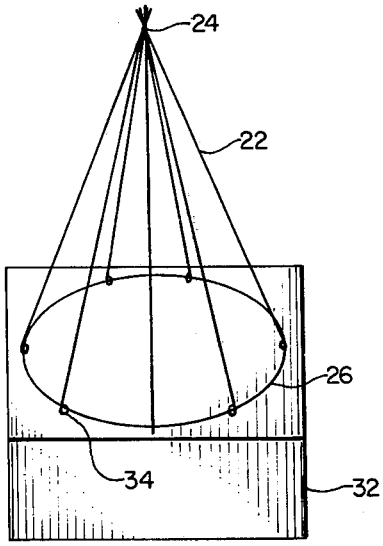
FIG. 4 is a perspective view of a third embodiment of this invention without the ornaments attached.
Figure 5:
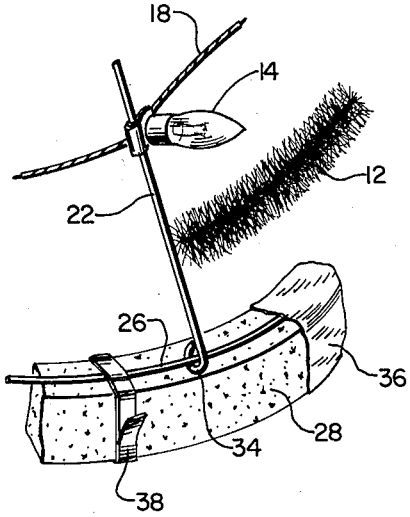
FIG. 5 is a partial perspective view of the embodiment of FIG. 1 showing in detail the connection of the attaching member to the base and the attachment of the elongated member to the attaching member.

FIGS. 2, 3 and 4 depict the structure which supports and gives shape to the ornamental tree shown in FIG. 1. FIG. 2 shows base 28 being a circular base. This base may be made of any material, however materials such as styrofoam are highly preferred due to their light weight and inexpensiveness. Attached to circular base 28 is attaching member 26. Attaching member 26 is attached to circular base 28 by means of tape 38 which is illustrated in FIG. 5. Other modes of attachment such as by staples, etc. may of course also be used. To give shape and support to the ornaments shown in FIG. 1, elongated members 22 are provided. As can be seen in the drawings, a plurality of wires are provided which are attached at one of their ends to attachment member 26 and at their other end one to the other to form apex 24 of the cone. Details of the connection of elongated members 22 to attachment member 26 is shown in FIG. 5. As can be seen, elongated member 22 has formed in one end thereof a loop 34 through which attachment member 26 passes. While this type of attachment is sufficient, it is preferable that this attachment be made more solid by soldering or taping.

FIG. 3 illustrates a second embodiment of this invention wherein the base is circular as is the case of FIG. 2, but in this embodiment the flat base 30 has a diminished thickness. Attachment of attachment member 26 to flat base 30 may be achieved either by taping as is the case in the embodiment shown in FIG. 2 or may be held in position by staples and the like.

In FIG. 4 a third embodiment is shown in which the base is square base 32. Attachment of attaching member 26 to square base 32 may be achieved by stapling, glueing or by the use of tape.

It should be pointed out that bases having other shapes than those pictured in FIGS. 2–4 may be utilized, the only requirement being that the base be capable of supporting the finished artificial, ornamental tree without rendering the tree unstable so that it has a tendency to tip over.

FIG. 5 shows one mode of attaching attachment member 26 to base 28. As can be seen in the drawing, tape 38 is utilized to achieve this attachment. This figure also illustrates the mode for attaching elongated member 22 to attachment member 26 by the utilization of loop 34 hereinbefore discussed.

Ornamental paper 36 may be wrapped around base 28, attachment member 26 and attachment tape 38 so as to hide unattractive construction.

It should also be noted that garland 12, lights 14 are attached to elongated members 22 by means of wrapping wire around electrical cord 18 and elongated member 22 and a separate piece of wire around garland 12 and elongated member 22. Other modes of attachment, of course, may be utilized and are within the skill of one skilled in the art.

Figure 6:
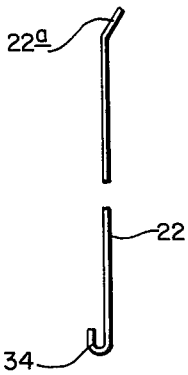
FIG. 6 is a fragmentary view of the elongated members shown in FIGS. 2, 3 and 4.

FIG. 6 shows elongated member 22. As can be seen, elongated member 22 has loop 34 at one end. The opposite end of elongated member 22 is bent to form an obtuse angle thus giving a bent portion 22*b* of elongated member 22. The function of loop 34 has been hereinabove discussed. The purpose of having bent portion 22*a* is to aid in attachment of elongated members 22 one to the other. It should be noted that for the elongated member shown in FIG. 6 the obtuse angle formed is formed on the side of elongated member 22 opposite that on which loop 34 is formed.

Elongated members 22 and attachment member 26 are preferably made of metallic wire. Wire of a size from 8 gauge to 14 gauge is suitable. The gauge utilized will, of course, be dependent upon the weight of the ornaments to be supported by the wire. If very heavy ornaments are utilized, a heavier gauge wire will be required. The construction of the bases may be of any light weight material such as styrofoam, cardboard or balsa wood. Other materials such as plastics and the like may also be utilized.

What is claimed is:

1. A self-supporting, ornamental, artificial tree consisting essentially of:

a. a base;

b. a circular attaching member secured to said base;

c. a plurality of straight, rigid elongated support members attached at one of their ends to said base by attachment means to said attaching member and attached at their other ends one to the other to form an apex of a cone shape, said attached support members together forming the cone-shaped ornament support frame, said elongated members have formed in one end thereof a loop through which said attaching member passes; and d. ornaments attached to said cone-shaped, ornament support frame.

2. The tree of claim 1 wherein said elongated members are of metal wire.

3. The tree of claim 1 wherein said base is substantially circular.

4. The tree of claim 3 wherein said attachment means is of metal wire and is a concentric ring attached to said substantially circular base.

5. The tree of claim 1 wherein said attachment means is of wire and is a ring attached to said base.

6. The tree of claim 5 wherein said attachment of said elongated members to said base is achieved by encircling said ring with a loop formed in the end of each of said elongated members attached to said ring.

7. The tree of claim 6 wherein said other end of said elongated member forms an obtuse angle on the opposite side of said formed loop.

8. The tree of claim 1 wherein said ornaments are garland and Christmas tree lights which are attached to said cone-shaped ornament frame to form a hollow cone having a continuous exterior surface.

* * * * *